United States Patent [19]

Sakai

[11] Patent Number: 4,482,870

[45] Date of Patent: Nov. 13, 1984

[54] MAGNETRON WITH MAGNETIC YOKE HAVING ANNULAR PROJECTION

[75] Inventor: Masao Sakai, Mobara City, Japan

[73] Assignee: Hitachi, Ltd., Tokyo, Japan

[21] Appl. No.: 312,245

[22] Filed: Oct. 19, 1981

[30] Foreign Application Priority Data

Oct. 24, 1980 [JP] Japan ..... 55-148306

[51] Int. Cl.[3] ..... H01J 25/50

[52] U.S. Cl. ..... 331/86; 315/39.53; 315/39.71

[58] Field of Search ..... 331/86–91; 315/39.53, 39.71, 39.51; 219/10.55 B

[56] References Cited

U.S. PATENT DOCUMENTS

| | | | |
|---|---|---|---|
| 4,205,256 | 5/1980 | Oguro | 315/39.51 |
| 4,282,463 | 8/1981 | Nakai | 315/39.71 |
| 4,325,003 | 4/1982 | Hatayama | 315/39.51 |

*Primary Examiner*—Siegfried H. Grimm

*Attorney, Agent, or Firm*—Charles E. Pfund

[57] ABSTRACT

In a magnetron of the type wherein a gasket member in the form of a fine metal wire net is disposed between a cup shaped sealing member on the output side, and a magnetic yoke providing a magnetic flux passage for permanent magnets contained in the magnetic yoke, a portion of the yoke is provided with an annular projection for snugly receiving the gasket member and a flat edge integral with the projection is provided between the annular projection and the cup shaped sealing member for supporting the gasket member.

1 Claim, 2 Drawing Figures

MAGNETRON WITH MAGNETIC YOKE HAVING ANNULAR PROJECTION

BACKGROUND OF THE INVENTION

This invention relates to a magnetron capable of preventing loss and leakage of microwave energy through an electroconductive sealing member interposed between the output member of the magnetron and the anode cylinder.

As shown in FIG. 1, in a prior art magnetron, an output member 3 is coupled to an anode cylinder 1 containing an oscillator cavity of a well known construction through a sealing member 2, and a cap 4 is mounted on the output member 3 to constitute an antenna.

Since the purpose of the gasket member 13 is to prevent leaks of microwave, it is made of electroconductive material, such as a fine wire net. An insulator 6 is sealed to the opposite end of the anode cylinder 1 via cup shaped sealing members to form a stem. A plurality of radially extending heat dissipating fins 7 are secured to the periphery of the anode cylinder 1. A pair of annular permanent magnets 8 and 9 are disposed to surround cup shaped sealing members 2 and 5 respectively. The permanent magnets 8 and 9 are supported by magnetic casings or yokes 10 and 11 which form a magnetic circuit for the magnetic flux produced by the permanent magnets 8 and 9. An annular gasket support 12 is disposed between the permanent magnet 8 and the yoke 10 to support a gasket member 13 disposed between the cup shaped sealing member 2 and the permanent magnet 8. A high frequency device such as a waveguide is urged against the gasket member 13 by screws or the like to bring the cup shaped sealing member 2, yoke 10 and the gasket support 12 into good electric contact with the gasket 13 to propagate the microwave energy through the coupling between the magnetron and the high frequency joint without loss and leakage.

Since in the prior art magnetron described above, the gasket support 12 is an indispensable element, the cost of manufacturing the magnetron increases. Moreover, since the gasket member 13 must have a sufficiently large resiliency, it is desirable to make large its thickness. Although the yoke 10 may have a thickness sufficient to provide a low reluctance flux passage, if its thickness is made to be smaller than that of the gasket member 13 there is a fear of dropping off of the gasket member 13 during transportation of the magnetron. For this reason, the thickness of the yoke 10 must be larger than that of the gasket member 13, thus increasing the weight and cost of manufacturing. Moreover, since the gasket member 13 is fitted between the yoke 10 and the cup shaped sealing member 2, it is necessary to assemble the yoke 10 with a perfect concentric relation with respect to the cup shaped sealing member 2. To this end it is necessary to use a special jig which degrades workability.

SUMMARY OF THE INVENTION

Accordingly, it is an object of this invention to provide an improved magnetron capable of assembling readily at a low cost.

Another object of this invention is to provide a novel magnetron capable of assembling with a lesser number of component parts than the prior art magnetron.

According to this invention there is provided a magnetron of the type comprising an anode cylinder containing an oscillator cavity, a pair of cup shaped sealing members connected to the opposite ends of the anode cylinder for forming an evacuated vessel togeher with the anode cylinder, one of the sealing members being connected to a lead of the magnetron, a pair of permanent magnets respectively surrounding the sealing members, a magnetic yoke encircling the permanent magnets for providing a magnetic flux passage therefor, and an electroconductive gasket member interposed between the one sealing member and the yoke, characterized in that there is provided an annular projection for a portion of the yoke for receiving the gasket member.

DESCRIPTION OF THE PREFERRED EMBODIMENT

Figure 1:
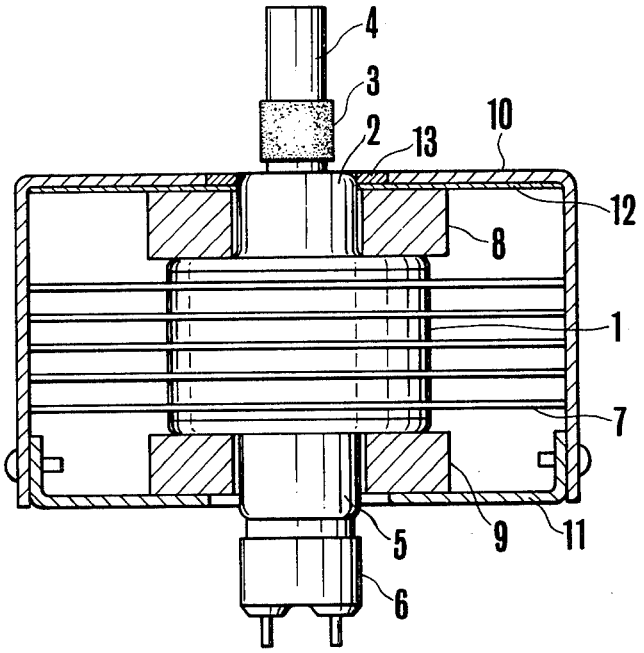
FIG.1 PRIOR ART
FIG. 1 is a longitudinal sectional view showing a prior art magnetron.
Figure 2:
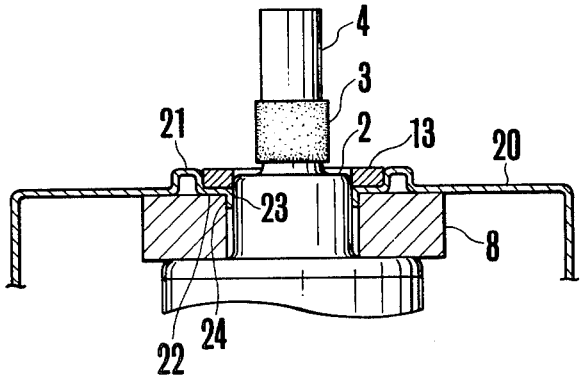
FIG. 2 is a partial sectional view showing essential elements of the magnetron embodying the invention.

In FIG. 2, elements identical to those shown in FIG. 1 are designated by the same reference numerals. The yoke 20 on the output side of the magnetron is provided with an annular projection 21 for snugly receiving the gasket member 13, a flat inner edge 22 for supporting the gasket member 13 and a cylindrical portion 24 extending downwardly from the opening 23 contacting the peripheral surface of the cup shaped sealing member 2.

Since an annular projection 21 is provided on the yoke 20 for receiving the gasket member 13, it is possible to decrease the thickness of the yoke 20, thus decreasing its weight and cost. Since the projection 21 can be readily formed with a press its height may be arbitrary so long as it can positively hold the gasket member 13. Moreover, as a flat inner edge 22 extending toward the cup shaped sealing member 2 and adapted to support the gasket member is formed integral with the other portions of the yoke 20 it is not necessary to provide a gasket support 12 as in the prior art construction, thus decreasing the number of the component parts.

Further, since the opening 23 constituted by the cylindrical portion 24 is formed to contact the periphery of the cup shaped sealing member 2, the yoke 20 can be worked and assembled to maintain perfect concentric relation with respect to the sealing member 2. It is not only possible to easily and stably mount the gasket 13 member but also to hold the gasket member 13 in a perfect concentric relation with respect to the sealing member 2, so that it is possible to efficiently prevent loss and leakage of the microwave energy as well as electric spark.

As can be noted from the foregoing description, the invention provides a reliable and low cost magnetron.

What is claimed is:

1. In a magnetron of the type comprising an anode cylinder containing an oscillator cavity;

a pair of cup shaped sealing members connected to the opposite ends of said anode cylinder for forming an evacuated vessel together with said anode cylinder;

one of said sealing members being connected to a load of said magnetron, a pair of permanent magnets respectively surrounding said sealing members, a magnetic yoke enclosing said permanent magnets for providing a magnetic flux passage therefor, and a ring shaped electroconductive gasket member having a central aperture interposed between said one sealing member and said yoke;

the improvement which comprises an external annular projection provided on a portion of said yoke to form an annular recess with said one sealing member projecting through said recess for receiving said gasket member snugly fitted between said annular projection and said one sealing member;

a flat edge extending radially inwardly from said annular projection toward an outer periphery of said one cup shaped sealing member for supporting a bottom portion of said gasket member; and a cylindrical flange depending from an inner end of said flat edge, said cylindrical flange forming a central opening for receiving said one sealing member in contact therewith.

* * * * *